US008690547B2

(12) United States Patent
Nagamatsu et al.

(10) Patent No.: US 8,690,547 B2
(45) Date of Patent: Apr. 8, 2014

(54) FAN

(75) Inventors: Hideki Nagamatsu, Kyoto (JP); Shoki Yamazaki, Kyoto (JP); Shigeyuki Moriya, Kyoto (JP)

(73) Assignee: Nidec Corporation, Kyoto (JP)

( * ) Notice: Subject to any disclaimer, the term of this patent is extended or adjusted under 35 U.S.C. 154(b) by 1443 days.

(21) Appl. No.: 11/930,912

(22) Filed: Oct. 31, 2007

(65) Prior Publication Data

US 2008/0112810 A1 May 15, 2008

Related U.S. Application Data

(63) Continuation-in-part of application No. 11/457,640, filed on Jul. 14, 2006, now abandoned.

(30) Foreign Application Priority Data

Jul. 15, 2005 (JP) ..... 2005-206455

(51) Int. Cl.
*F04B 35/04* (2006.01)

(52) U.S. Cl.
USPC ..... 417/354

(58) Field of Classification Search
USPC ..... 417/354, 423.14, 420; 310/62, 63; 29/889.3, 889.4, 888.05; 415/915; 264/645
See application file for complete search history.

(56) References Cited

U.S. PATENT DOCUMENTS

| | | | | |
|---|---|---|---|---|
| 3,961,864 | A * | 6/1976 | Papst et al. | 417/354 |
| 4,164,690 | A * | 8/1979 | Muller et al. | 318/400.41 |
| 5,399,070 | A * | 3/1995 | Alizaden | 416/189 |
| 5,663,604 | A * | 9/1997 | Takahashi | 310/91 |
| 6,107,708 | A * | 8/2000 | Yamaguchi et al. | 310/58 |
| 6,262,510 | B1 * | 7/2001 | Lungu | 310/216.023 |
| 6,278,207 | B1 * | 8/2001 | Matsumoto | 310/88 |
| 6,394,768 | B1 * | 5/2002 | Fukuda et al. | 417/423.15 |
| 6,437,471 | B1 * | 8/2002 | Ogawara et al. | 310/90 |
| 6,468,038 | B1 * | 10/2002 | Kikuchi et al. | 416/178 |
| 6,488,485 | B1 * | 12/2002 | Rupp et al. | 417/423.7 |
| 6,545,381 | B1 * | 4/2003 | Fehrenbacher | 310/90 |

(Continued)

FOREIGN PATENT DOCUMENTS

| | | | |
|---|---|---|---|
| DE | 4042127 | A1 * | 7/1992 |
| JP | 62-26639 | Y2 | 7/1987 |
| JP | 7-46811 | A | 2/1995 |
| JP | 7-75288 | A | 3/1995 |
| JP | 2711718 | B2 | 2/1998 |
| JP | 2006-105013 | A | 4/2006 |

OTHER PUBLICATIONS

DE4042127 abstract;Jul. 1992;Severyns,Horst Willy.*
Hideki Nagamatsu et al.; "Fan Assembly"; U.S. Appl. No. 11/457,640, filed Jul. 14, 2006.

*Primary Examiner* — Devon Kramer
*Assistant Examiner* — Amene Bayou
(74) *Attorney, Agent, or Firm* — Keating & Bennett, LLP

(57) ABSTRACT

A fan includes an impeller portion generating an air flow and a motor that rotates the impeller portion about a center axis. The impeller portion is attached to a yoke of a rotor portion of the motor and is rotated with the yoke. A circular portion of the impeller is attached to a bottom opening of the yoke having a cylindrical shape whose top is covered by insert molding. Therefore, the impeller and the yoke may be securely fixed to each other. In addition, an outer side surface of the yoke is exposed to outside air such that the space arranged inward from the plurality of blades may be enlarged.

26 Claims, 20 Drawing Sheets

(56) References Cited

U.S. PATENT DOCUMENTS

| | | | | |
|---|---|---|---|---|
| 6,551,074 | B2 * | 4/2003 | Kudo et al. | 417/354 |
| 6,586,853 | B2 | 7/2003 | Ishida et al. | |
| 6,685,430 | B2 * | 2/2004 | Chapman | 415/208.2 |
| 6,844,641 | B1 * | 1/2005 | Horng et al. | 310/89 |
| 6,979,177 | B2 * | 12/2005 | Lin et al. | 416/181 |
| 7,207,774 | B2 * | 4/2007 | Kashiwazaki et al. | 415/206 |
| 7,476,076 | B2 * | 1/2009 | Shimada | 415/58.4 |
| 2002/0023728 | A1 * | 2/2002 | Kikuchi et al. | 164/113 |
| 2002/0061145 | A1 * | 5/2002 | Kobayashi et al. | 384/276 |
| 2004/0191088 | A1 * | 9/2004 | Matsumoto | 417/354 |
| 2004/0212262 | A1 * | 10/2004 | Chiu et al. | 310/91 |
| 2005/0207888 | A1 * | 9/2005 | Kashiwazaki et al. | 415/206 |
| 2007/0014675 | A1 | 1/2007 | Nagamatsu et al. | |
| 2007/0098571 | A1 | 5/2007 | Nagamatsu | |

* cited by examiner

FAN

BACKGROUND OF THE INVENTION

1. Field of the Invention

The present invention generally relates to an electrically powered fan used to blow air.

2. Description of the Related Art

Conventionally, a centrifugal type fan, taking air in an axial direction and exhausting the air in a radial direction, has the following configuration. Specifically, the conventional fan includes an impeller having a plurality of blades arranged in a circumferential direction centered about a center axis, and a substantially cup-shaped portion arranged at the middle of the impeller into which a substantially cylindrical yoke made of magnetic material is press-fitted. In addition, a field magnet is attached to an inner side surface of the yoke. By virtue of this configuration, the impeller is rotatably supported around the center axis. The blades of the impeller are arranged on radially outer positions of the cup-shaped portion, and the cup-shaped portion and the blades are unitarily formed of synthetic resin, both of which are connected via a joint portion. By virtue of this configuration, a circular space is provided between the plurality of blades and the outer side surface of the cup-shaped portion.

In terms of a centrifugal fan, it may be preferable to enlarge the space provided at an inner side of the plurality of blades (in other words, the space between radially inner end portions of the blades and the outer side surface of the cup-shaped portion, to which the yoke is press-fitted, is made wider). With the wider space, the fan may take more air therein, which results in improved blower efficiency of the fan. However, upon making a diameter of the yoke smaller to enlarge the space, a magnetic circuit will be decreased in size. As a result, the motor efficiency is degraded. Upon making a diameter of the circular space bigger while fixing an outer diameter of the impeller, a blade-area will be decreased in size, which results in degraded blower efficiency. Upon making a diameter of the circular space bigger while keeping the blade-area of the impeller constant, the impeller will be enlarged.

In order to enlarge the circular space without expanding the outer diameter of the impeller or degrading the blower efficiency, it is preferable to omit the cup shaped portion of the impeller covering the outer side surface of the yoke.

In publicly available examples, a portion of the outer side surface around the opening of the permanent-magnet rotor having a cylindrical shape whose top is covered, and an inner side surface of the cylindrical portion provided at a middle of the impeller are fixed by, for example, press-fitting, bonding, and crimp-fixing. In another publicly available example, a flange portion is provided around the outer side surface of the opening of the permanent-magnet rotor, and the flange portion is fixed to the base plate of the centrifugal fan by crimp-fixing.

However, in case that the permanent-magnet rotor and the cylindrical portion arranged at the middle portion of the impeller are press-fitted or bonded, an axial length of an affixing area at which the outer side surface of the permanent-magnet rotor is abutted against the impeller is short. Therefore, the impeller may not be fixed securely to the permanent-magnet rotor by press-fitting or bonding. For crimp-fixing, forming the engaging portion and crimping processes are required, which may deteriorate the work efficiency.

Furthermore, the cup shaped portion of the impeller, which is made of resin, may be broken or cracked by the stress generated upon press-fitting the permanent magnet rotator (i.e., the cylindrical yoke made of metallic material with the field magnet attached to the inner side surface thereof) into the cup-shaped portion. Especially in a large-size fan, it is highly probable that the impeller is damaged or cracked. On the other hand, if the press-fit pressure is reduced, the permanent-magnet rotor may not be securely fixed to the impeller. As a result, the permanent-magnet rotor may detach from the impeller.

In case that such a fan is utilized in a low temperature environment, the impeller made of resin shrinks more than the yoke made of metallic material does, which results in breaking or cracking of the attaching portion of the impeller and the yoke.

SUMMARY OF THE INVENTION

In order to overcome the problems described above, preferred embodiments of the present invention provide an impeller portion securely fixed to the yoke while improving the blower efficiency of a fan, and the breaking or the cracking of the impeller portion caused by thermal deformation is prevented.

According to one preferred embodiment of the present invention, a fan includes a stator unit and a rotor unit is provided. The rotor unit is rotatable about a center axis and includes a yoke made of metal and having a substantially cylindrical shape centering on the center axis, and an impeller portion made of resin. The impeller portion has a connecting portion and a plurality of blades arranged around the center axis on the connecting portion, the connecting portion is fixed to the yoke. The connecting portion of the impeller portion is attached to the yoke by insert molding. Furthermore, the yoke includes an innate surface which is a portion of an outer side surface of the yoke without covered by the connecting portion, and the impeller portion takes air from a direction along the center axis, exhausts air into a direction being away from the center axis. In the fan mentioned above, an outer side surface of the yoke may be exposed to outside air of the fan. As a result, the impeller portion and the yoke are securely fixed while improving the blower efficiency of the fan.

It should be understood that in the explanation of the present invention, when positional relationships among and orientations of the different components are described as being up/down or left/right, positional relationships and orientations that are in the drawings are indicated, however, positional relationships among and orientations of the components once having been assembled into an actual device are not indicated.

Other features, elements, processes, steps, characteristics and advantages of the present invention will become more apparent from the following detailed description of preferred embodiments of the present invention with reference to the attached drawings.

DETAILED DESCRIPTION OF PREFERRED EMBODIMENTS

Figure 1:
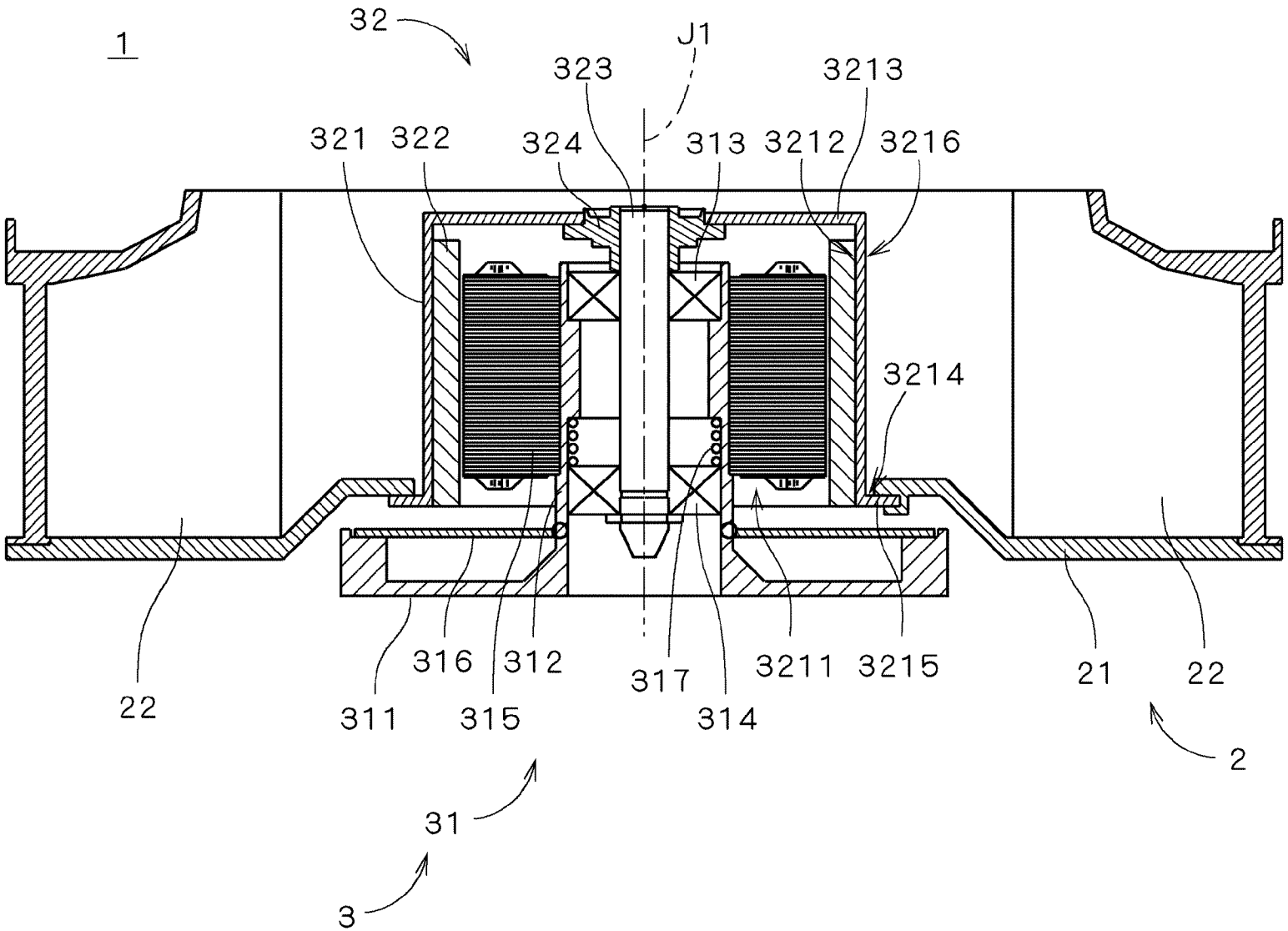
FIG. 1 is a cross sectional view illustrating a fan according to a first preferred embodiment of the present invention.

FIG. 1 is a vertical sectional view of a fan 1 along a plane including a center axis J1, illustrating a configuration of the centrifugal type fan 1 according to a first preferred embodiment of the present invention. As shown in FIG. 1, the fan 1 includes an impeller portion 2 and a motor 3. The impeller portion 2 is attached to the motor 3 and generates air flow by rotation thereof. The motor 3 rotates impeller 2 about a center axis J1. The fan 1 is accommodated within a housing (not shown) which defines a passage of air flow. In other words, the housing controls the air flow generated by the rotation of the impeller and sends the air outside of the housing. The fan 1 is, for example, used as an air cooling fan for an electronic device.

The motor 3 is an outer rotor type motor, including a stator portion 31 which is a stationary assembly and a rotor portion 32 which is a rotary assembly. The rotor portion 32 is supported rotatably on the stator portion 31 with the center axis J1 as a center by a bearing mechanism 312 explained below. For convenience in the following explanation, the rotor portion 32 side along the center axis J1 will be described as an upper side and the stator portion 31 side as a bottom end, but the center axis J1 need not necessarily coincide with the direction of gravity.

The stator portion 31 includes a base portion 311 which retains the different parts of the stator portion 31. The base portion 311 includes a bearing supporting portion having a substantially cylindrical shape centered on the center axis J1. The bearing supporting portion protrudes in the upward direction (i.e., toward the rotor portion 32 side) from the base portion 311. Ball bearings 313 and 314 are arranged at positions within the bearing supporting portion at an axially upper portion and an axially bottom portion, respectively. Moreover, a preloaded spring 317 is provided at a bottom side of bearing mechanism 312.

The stator 31 also includes an armature 315 which is attached to an outer side surface of the bearing mechanism 312 (i.e., the armature 315 is attached to the base portion 311 near the bearing supporting portion) and a circuit board 316 which is arranged on the base portion 311 below the armature 315 and is electrically connected to the armature 315.

The rotor portion 32 includes a covered cylindrical yoke 321 which is made of metallic material and has an opening 3211 on the bottom side thereof (i.e., the stator 31 side), a field magnet 322 which is attached to an inner side surface 3212 of the yoke 321 so as to face the armature 315, and a shaft 323 which downwardly protrudes from an upper portion 3213 of the yoke 321 (i.e., a substantially disk-shaped portion arranged on the upper end portion of the yoke 321).

The yoke 321 includes a substantially annular flange portion 3215 which extends in a direction that is substantially perpendicular to the center axis J1 and is arranged around the opening 3211 (i.e., the bottom end portion of the yoke 321 facing the armature 315, and hereinafter the portion is referred to as a opening portion 3214).

As shown in FIG. 1, in the fan 1, an outer side surface 3216 of the yoke 321 is not covered by a portion of the impeller 2 (i.e., the yoke 321 includes an innate surface which is exposed to outside air). It should be noted that a state in which the outer side surface 3216 of the yoke 321 is exposed to the outside air includes a state in which the yoke 321 is covered with a thin layer to protect the surface thereof and exposes an outer surface of the thin layer to the outside air. In other words, in the fan 1, an outer side surface of a member which is normally recognized as the yoke 321 is not covered with the impeller portion and is exposed to the outside air.

A bushing 324 is crimp-fitted to the upper portion 3213 of the yoke 321, and the shaft 323 is fixed to the bushing 324 by press-fitting. Then the shaft 323 is inserted into the bearing supporting portion 312 such that the shaft 323 is rotatably supported by the ball bearings 313 and 314. In the fan 1, the shaft 323, the ball bearing 313, and the ball bearing 314 define the bearing mechanism 312 which supports the yoke 321 about center axis J1 in a manner rotatable relative to the base portion 311. Then, torque (i.e., rotation force) centered on the center axis J1 is generated between the field magnet 322 and the armature 315 by controlling power input to the armature 315 through a circuit board 316. The torque rotates the yoke 321, shaft 323, and the impeller 2 attached to the yoke 321 with the center axis J1 as the center. Meanwhile, the shaft 323 may be directly attached to the yoke 321, in which case the bushing 324 would be omitted.

The impeller portion 2 includes a connecting portion having a discoid circular shape and extending in a radially outward direction (i.e., the direction away from the center axis J1) from the opening portion 3214 of the yoke 321, and a plurality of blades 22 (for example, 11 blades in this preferred embodiment of the present invention) arranged in an equally spaced manner in the circumferential direction centered about the center axis J1 with a space maintained on an inner side of the blades.

Figure 2:
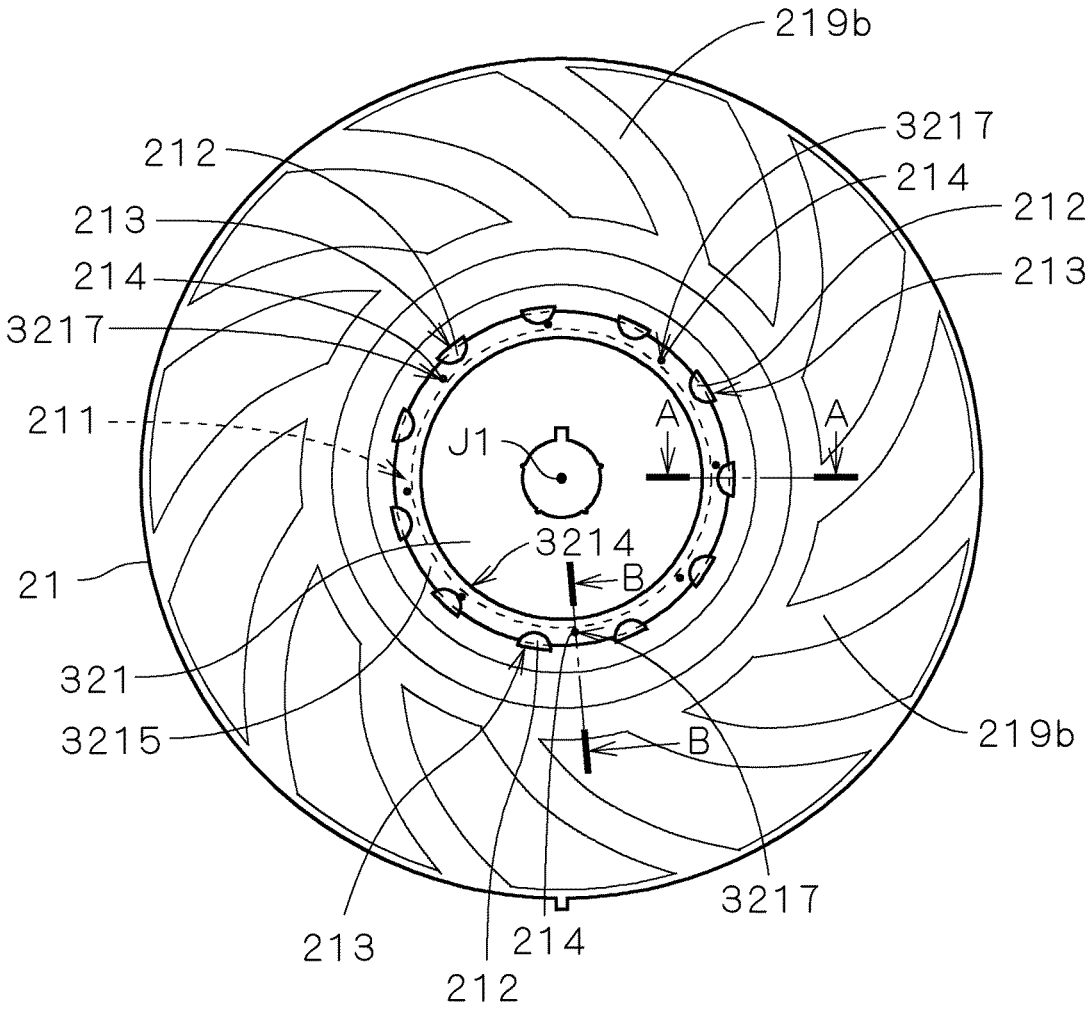
FIG. 2 is a bottom plan view illustrating a yoke and a connecting portion.
Figure 3:
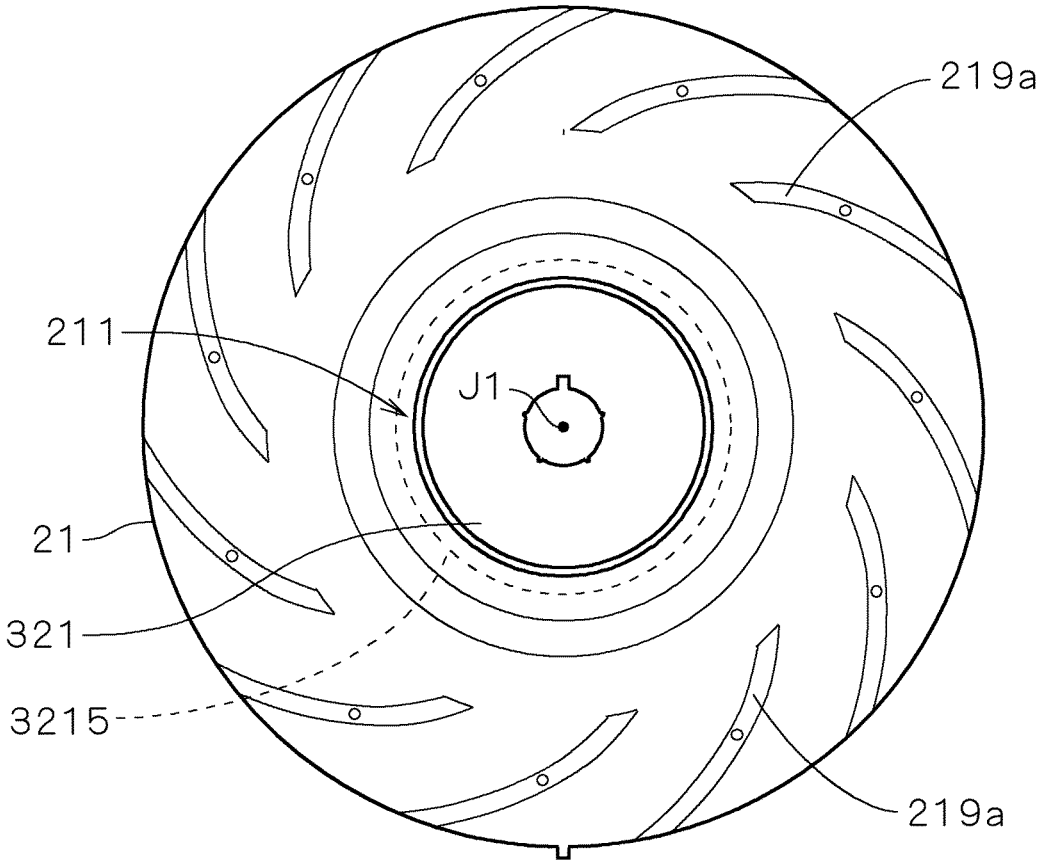
FIG. 3 is a plan view illustrating the yoke and the connecting portion.

The connecting portion 21 firstly extends in the radially outward direction on a plane that is substantially the same plane where the flange portion 3215 is arranged, secondly inclines in the axially downward direction near the outer circumference of the base portion 311, and then, thirdly extends in the radially outward direction from inner end portions (i.e., the center axis J1 side portions) of the blades 22 on a plane that is substantially the same plane where the circuit board 316 is arranged. As shown in FIG. 3, a plurality of shallow grooves 219*a* having circular arc shapes (11 grooves in this preferred embodiment) are provided on an upper surface of a radially outward portion of the connecting portion 21. As shown in FIG. 2, a plurality of convex portions 219*b* having circular arc shapes arranged in a spiral manner are provided on a bottom surface of the radially outward portion of the connecting portion 21, a position of each convex portion corresponding to that of each shallow groove 219*a*, respectively.

Each of the plurality of blades 22 extends upwardly from the upper surface of the connecting portion 21 (i.e., a yoke 321 side surface of the connecting portion 21) substantially parallel to the center axis J1. The plurality of blades 22 are unitarily formed by connecting upper end portions thereof with an annular connecting part having an outer side surface in a circular truncated cone shape. The plurality of unitary blades 22 are arranged in the grooves 219*a* of the connecting portion 21 and are fixed to the connecting portion 21 preferably by ultrasonic welding. In the centrifugal fan 1, the air is taken into the fan 1 from the upper side thereof (i.e., the upper portion 3213 side of the yoke 321) and the air taken into the fan is exhausted in the radial direction away from the center axis J1 by rotating impeller portion 2 and the yoke 321.

Figure 4:
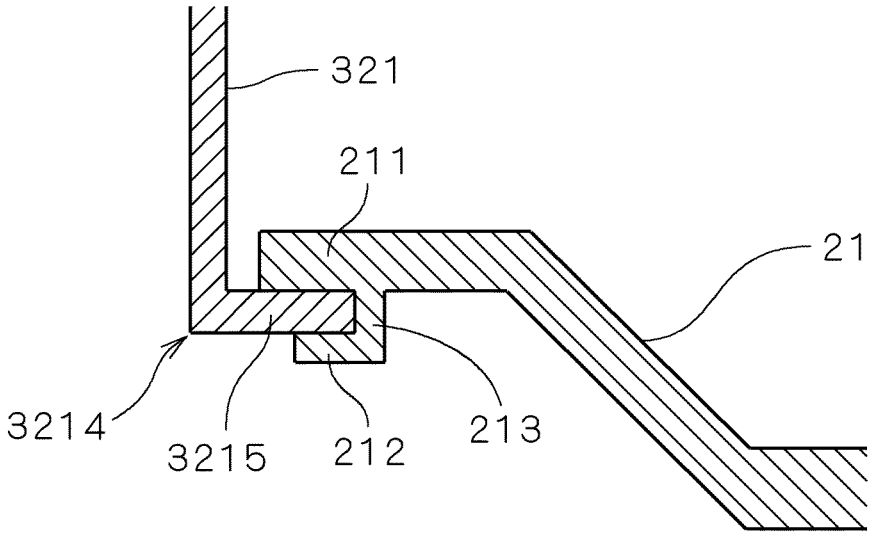
FIG. 4 is a partial sectional view illustrating the yoke and the connecting portion.
Figure 5:
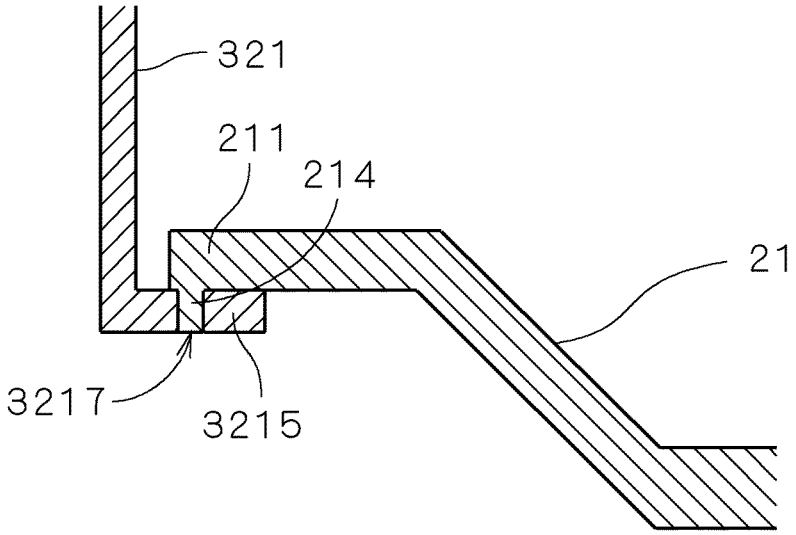
FIG. 5 is a partial sectional view illustrating the yoke and the connecting portion.

FIGS. 2 and 3 are plan views showing the yoke 321 of the rotor portion 32 and the connecting portion 21 of the impeller portion 2 attached to the yoke 321. FIGS. 4 and 5 are partial sectional views illustrating sections of the yoke 321 and the connecting portion 21 along section A-A and section B-B shown in FIG. 2, respectively.

As shown in FIGS. 2 to 5, an upper affixing portion 211 of an inner peripheral side of the connecting portion 21 is abutted against the upper surface of the flange portion 3215 of the yoke 321 along the entire circumference and centered about the center axis J1. As shown in FIGS. 2 to 4, the connecting portion 21 includes a plurality of bottom affixing portions 212 (11 portions in this preferred embodiment), at which the connecting portion 21 is abutted against a bottom surface of the flange portion 3215, wherein the plurality of bottom affixing portions 212 are arranged in a circumferential direction centered about the center axis J1. By virtue of the configuration mentioned above, the flange portion 3215 is sandwiched by the upper affixing portions 211 and the bottom affixing portions 212 of the connecting portion 21.

The bottom affixing portions 212 include a plurality of side affixing portions 213 (for example, 11 portions in this preferred embodiment) at which the connecting portion 21 is abutted against an outer circumferential surface of the flange portion 3215, wherein the plurality of side affixing portions 213 are arranged in a circumferential direction centered about the center axis J1 and connect the plurality of bottom affixing portions 212 and the upper affixing portions 211. In the connecting portion 21, the bottom affixing portions 212 and the side affixing portions 213 are arranged in an equally spaced manner in the circumferential direction.

As shown in FIGS. 2 to 5, the flange portion 3215 of the yoke 321 includes a plurality of through holes 3217 (for example, 8 through holes in this preferred embodiment), which axially penetrate the flange portion 3215 and are arranged in an equally spaced manner in the circumferential direction centered about the center axis J1. Moreover, the through holes 3217 are arranged at positions facing the upper affixing portions 211 of the connecting portion 21. The connecting portion 21 includes a plurality of convex portions 214 (for example, 8 convex portions in this preferred embodiment), each of which is inserted into a through hole 3217 to prevent relative movement in the circumferential direction about the center axis J1 between the yoke 321 and the impeller portion 2.

As described above, the connecting portion of the impeller 2 is fixed to the yoke 321 of the flange portion 3215 by insert molding. Upon insert molding of the connecting portion 21, the yoke 321 is arranged within a die having an internal space in a predetermined shape, and a melted resin material is injected from a plurality of gates arranged on the die to fill the internal space of the die. Then, the resin material is solidified by cooling the die. As a result, the connecting portion 21 is formed while the connecting portion 21 is fixed to the flange portion 3215 of the yoke 321 by injection molding.

Upon forming the connecting portion 21, weld lines are formed at portions in which a melted resin material injected from the different gates flow together. Specifically, the weld line is formed at the intersection of two confronting-flow fronts of the melted resin which temperature is relatively lower than other portions of the resin-flow. As explained above, the condition of the molding material at the molding line is different from that at the other portions, which normally results in degrading the strength at the portion where the welding line is formed.

Figure 6:
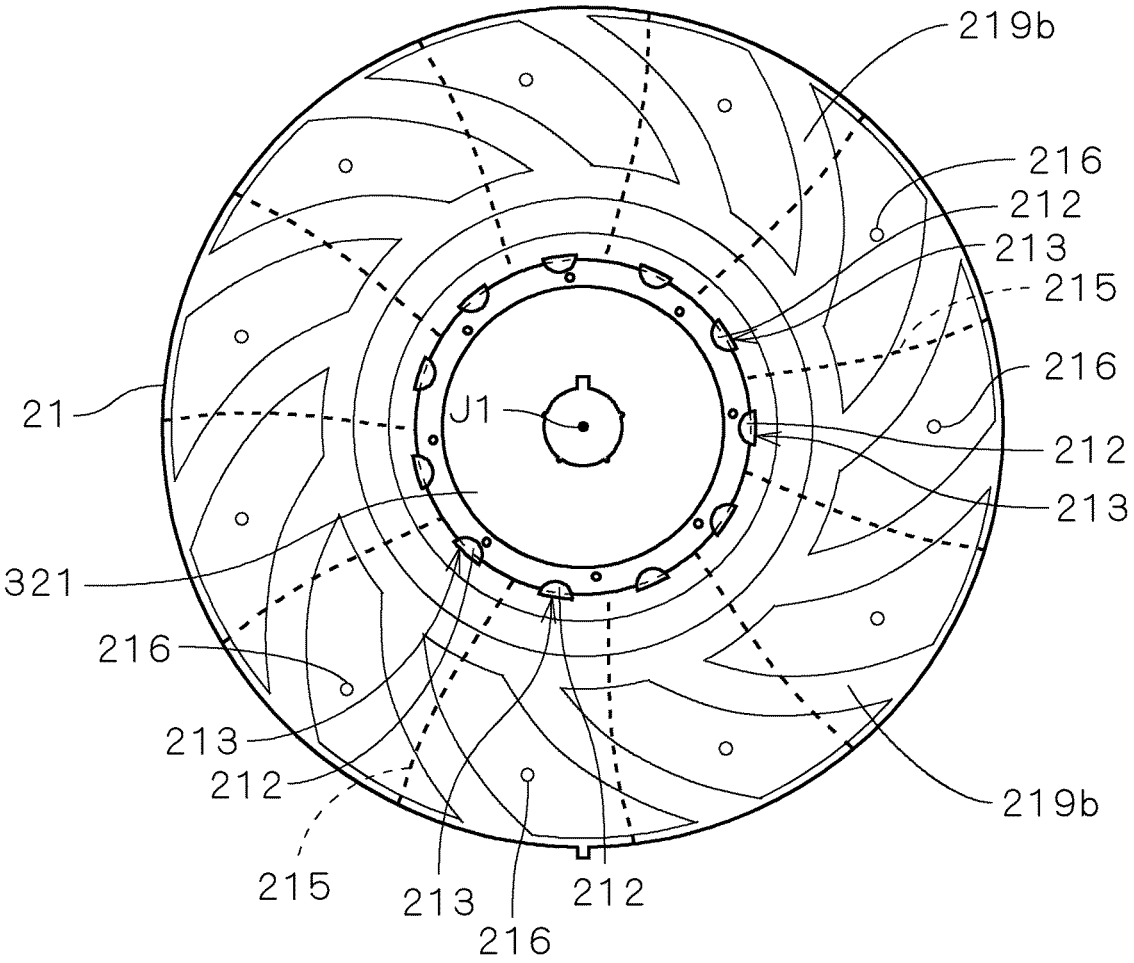
FIG. 6 is a bottom plan view illustrating the yoke and the connecting portion.

FIG. 6 is a bottom plan view illustrating the yoke 321 and the connecting portion 21. A plurality of weld lines 215 formed on the connecting portion 21 are illustrated by broken lines. Gate marks 216 formed at positions corresponding to those of the gates arranged on the die are also illustrated in FIG. 6. In the die used for molding the connecting portion 21, each gate is arranged at a position outside that of the corresponding side affixing portion 213 and bottom affixing portion 212 (i.e., the positions of the gates correspond to gate marks 216 formed between the adjacent convex portions 219*b*, and are on the lines connecting the center axis J1 and each side affixing portion 213). The resin material is injected from each of the gates with substantially the same injection pressure, which results in forming the weld line 215 at a substantially middle portion between adjacent gates. By virtue of this configuration, the plurality of weld lines 215 extend radially on the connecting portion 21 about the center axis J1, and each weld line 215 passes between two adjacent side affixing portions 213.

As explained above, in the fan 1 according to the present preferred embodiment of the present invention, the connecting portion 21 of the impeller portion 2 is attached to the opening portion 3214 of the yoke 321 by insert molding. Therefore, the impeller portion 2 is securely fixed to the yoke 321 even in the case that the affixing area of the impeller portion 2 and the yoke 321 is relatively small. Moreover, the impeller portion 2 may be attached to the yoke 321 when molding the impeller portion 2.

In terms of the fan 1, the outer side surface 3216 of the yoke 321 is not covered by a portion of the impeller portion 2 (i.e., the outer side surface 3216 of the yoke 321 directly faces the plurality of blades 22), the space arranged inside the plurality of blades 22 of the impeller portion 2 may be enlarged in the radial direction about the center axis J1 compared with a fan in which the outer side surface of the yoke is covered with a portion of the impeller (i.e., the distance between the inner side end portion of the blade 22 and the portion of the member facing thereto (the outer side surface 3216 of the yoke in this preferred embodiment) may be enlarged). As a result, the blower efficiency of the fan 1 may be improved.

In addition, the heat generated by a member arranged within the yoke 321, such as the armature 315, may be easily diffused to outside of the yoke 321. As a result, the temperature of the fan 1 may be easily controlled.

In the fan 1 according to the present preferred embodiment of the present invention, the connecting portion 21 of the impeller portion 2 is fixed to the flange portion 3215 extending in a radially outward direction perpendicular to the center axis J1. By virtue of this configuration, an attaching portion of the impeller portion 2 may be simplified. Moreover, the flange portion 3215 is axially sandwiched between the upper affixing portion 211 and the bottom affixing portion 212 according to the present preferred embodiment of the present invention. By virtue of this configuration, the impeller portion 2 is securely fixed to the yoke 321 while simplifying the structure of the attaching portion of the impeller portion 2. Furthermore, by inserting the convex portions 214 of the connecting portion 21 into the through holes 3217 of the flange portion 3215, it is possible to prevent relative movement in the circumferential direction between the impeller portion 2 and the yoke 321. Additionally, by inserting the convex portions 214 into the through holes 3217, an affixing area of the connecting portion 21 to the yoke 321 is enlarged, which results in fixing the connecting portion 21 and the yoke 321 more securely.

In terms of the impeller 2, the plurality of side affixing portions 213 of the connecting portion 21 are intermittently fixed to the outer circumferential surface of the flange portion 3215 along the outer circumferential surface around the opening portion 3214 of the yoke 321. Therefore, even if the fan 1 is placed in a low temperature environment and the connecting portion 21 made of resin shrinks more than the yoke 321 made of metallic material, it is possible to prevent the impeller portion 2 from being damaged or cracked by thermal deformation because each side affixing area 213 includes a clearance in the circumferential direction (i.e., deformable space), which reduces the stress circumferentially applied to the connecting portion 21.

Furthermore, according to this preferred embodiment, the connecting portion 21 is formed by insert molding such that each of the plurality of weld lines 215 passes between the adjacent side affixing portions 213 (i.e., a radially inward end portion of each weld line 215 does not overlap the side affixing portions 213). By virtue of this configuration, the stress caused by thermal deformation (specifically, the thermal shrinkage) is not forcefully applied to the weld lines 215, and it is possible to prevent the impeller portion 2 from being damaged or cracked by the thermal deformation.

Figure 7:
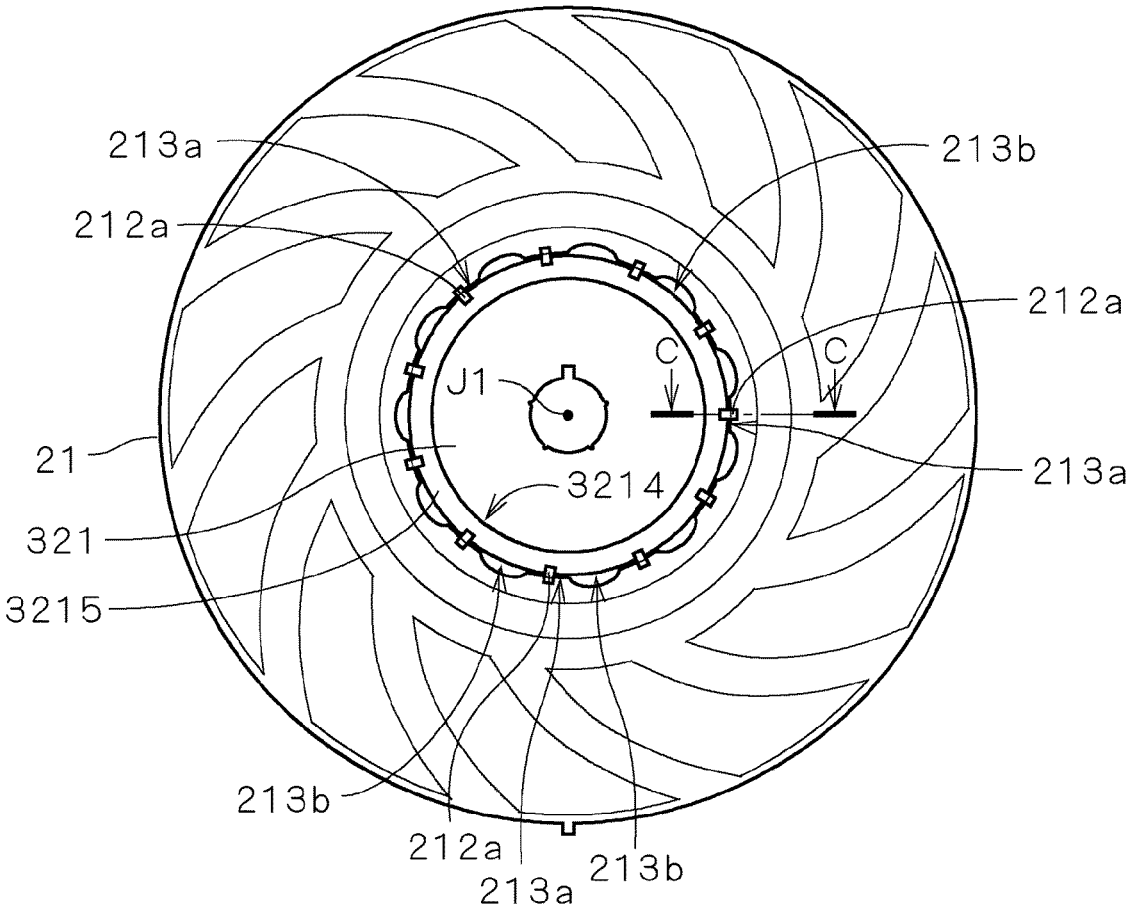
FIG. 7 is a bottom plan view illustrating another example of the yoke and the connecting portion.
Figure 8:
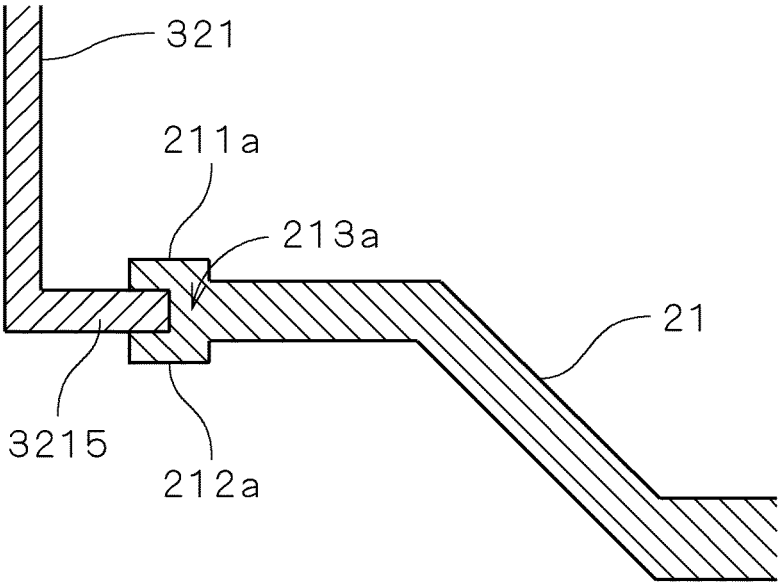
FIG. 8 is a partial sectional view illustrating another example of the yoke and the connecting portion according to another preferred embodiment of the present invention.

FIG. 7 is a bottom plan view illustrating the connecting portion 21 attached to the yoke 321 according to another preferred embodiment of the present invention. FIG. 8 is a partial sectional view illustrating the yoke 321 and the connecting portion 21 along section C-C shown in FIG. 7. In the present preferred embodiment, the connecting portion 21 may extend in a radially outward direction perpendicular to the center axis J1.

In the preferred embodiment shown in FIGS. 7 and 8, a plurality of notched portions 213*b* are arranged on an inner side portion of the connecting portion 21, and an inner side surface of an affixing portion 213*a* arranged between two adjacent notched portions 213*b* is abutted against the outer side surface of the flange portion 3215. In other words, the inner side surface of the plurality of affixing portions 213*a* arranged in the circumferential direction about the center axis J1 are intermittently abutted against the outer side surface around the opening portion 3214 of the yoke 321.

As shown in FIGS. 7 and 8, an upper affixing portion 211*a* and a bottom affixing portion 212*a* are provided on an upper surface and a bottom surface of the affixing portion 213*a*. The upper affixing portion 211*a* and the bottom affixing portion 212*a* abut against an upper surface and a bottom surface of the flange portion 3215 of the connecting portion 21 respectively, such that the upper and the bottom affixing portions sandwich the flange portion 3215. The connecting portion 21 is fixed to the yoke near the opening portion 3214 by insert molding. The notched portions 213*b* arranged between the affixing portions 213*a* are formed concurrently with the insert molding of the connecting portion 21 by providing a plurality of convex portions within the die. The weld lines (not shown in FIGS. 7 and 8) extend radially outward from positions corresponding to the notched portions 213*b*.

In the preferred embodiment shown in FIGS. 7 and 8, even in the case that the fan 1 is placed in a low temperature environment and the connecting portion 21 made of resin shrinks more than the yoke 321 made of metallic material does, it is possible to prevent the impeller portion 2 from being damaged or cracked by thermal deformation because each side affixing area 213*a* includes a clearance in the circumferential direction (i.e., notched portions 213*b* as deformable spaces), which reduces the stress circumferentially applied to the connecting portion 21. In case that the thermal shrinkage ratios of the connecting portion 21 and the yoke 321 are substantially the same, it is even less likely that the impeller portion 2 is damaged or cracked by the thermal deformation. In such case, the connecting portion 21 may include an affixing portion whose inner side surface abuts against the flange portion 3215 along the entire circumference of the flange portion 3215.

Figure 9:
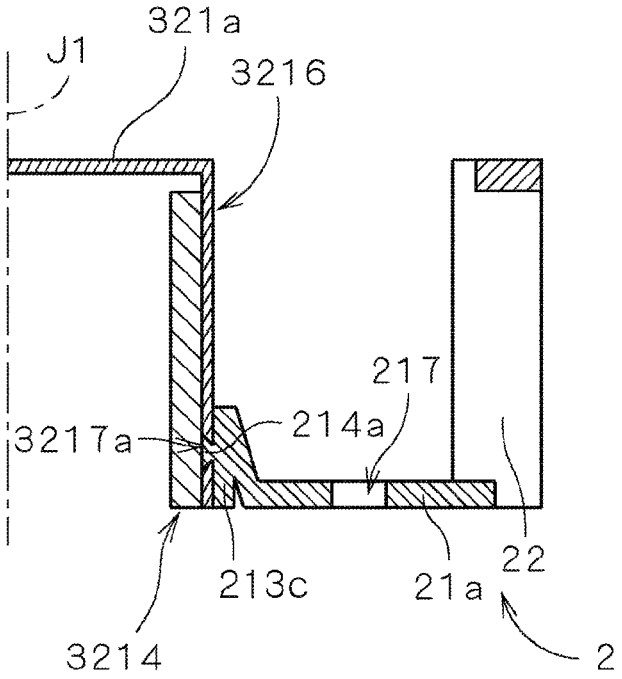
FIG. 9 is a cross sectional view illustrating a fan according to a second preferred embodiment of the present invention.

Next, a fan according to a second preferred embodiment of the present invention will be explained. FIG. 9 is a cross sectional view illustrating a yoke 321*a* and the impeller portion 2 of a fan according to a second preferred embodiment of the present invention. Unlike the fan 1 shown in FIG. 1, the fan according to the second preferred embodiment does not include a flange portion around the opening portion 3214 of the yoke 321*a*.

As shown in FIG. 9, in the fan according to the second preferred embodiment, a connecting portion 21*a* of the impeller portion 2 is fixed to the outer side surface 3216 around a bottom end portion (i.e., opening portion 3214) of the yoke 321*a* by insert molding. An affixing portion 213*c* of the connecting portion 21*a* which abuts against the yoke 321*a* on the inner side of the connecting portion 21*a* covers a portion of the outer side surface 3216 of the yoke 321*a*. Other portions of the outer side surface 3216 are not covered with the impeller portion 2. Therefore, like the first preferred embodiment, the impeller portion 2 is securely fixed to the yoke 321*a* while improving the blower efficiency of the fan.

On a bottom side surface of the yoke 321*a*, a plurality of holes 3217*a* are intermittently arranged in the circumferential direction. In addition, a plurality of convex portions 214*a* to be inserted into the holes 3217*a* are formed on the affixing portion 213*c* of the connecting portion 21*a* by insert molding. By this configuration, like the first preferred embodiment of the present invention, it is possible to prevent relative movement in the circumferential direction between the impeller portion 2 and the yoke 321*a* when the impeller portion 2 rotates.

The affixing portion 213*c* may be intermittently abutted against the outer side surface 3216 of the yoke 321*a* in the circumferential direction centered about the center axis J1. In other words, the connecting portion 21*a* may include a plurality of affixing portions which are arranged in the circumferential direction and intermittently abut against the outer side surface 3216 of the yoke 321*a*. Therefore, like the first preferred embodiment, it is possible to prevent the impeller portion 2 from being damaged or cracked by thermal deformation even in the case that the fan 1 is placed in a low temperature environment and the connecting portion 21*a* made of resin shrinks more than the yoke 321*a* made of metallic material does.

In the fan according to the second preferred embodiment of the present invention, the connecting portion 21*a* and the plurality of blades 22 are unitarily formed. The connecting portion 21*a* includes a plurality of through holes 217 which are circumferentially arranged between the affixing portions 213*c* and the blades 22. Upon rotating the impeller portion 2, air is taken via the through holes 217 arranged on the bottom side of the connecting portion 21*a* and is fed to the blades 22. If needed, the fan may take the configuration in which the air is taken from the upper side of the connecting portion 21*a* via the through holes 217 and is fed to the bottom side of the connecting portion 21*a*.

Figure 10:
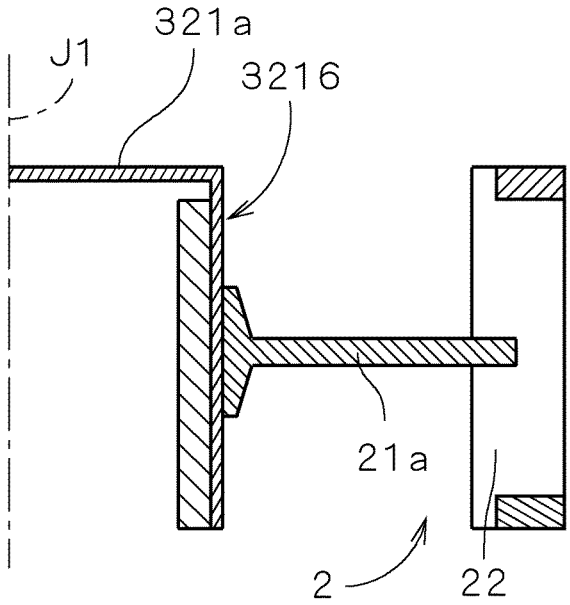
FIG. 10 is a partial cross sectional view illustrating another example of the yoke and the impeller portion.

The fan may take the configuration in which the air is taken from both axially upper and bottom sides by rotating the impeller portion 2. FIG. 10 is a partial sectional view illustrating another preferred embodiment of the connecting portion 21*a* fixed to the yoke 321*a*. In the preferred embodiment of the present invention shown in FIG. 10, the connecting portion 21*a* is securely fixed to a substantially axially middle position of the outer side surface 3216 of the yoke 321*a* by insert molding. In this case, the air taken from axially upper and bottom sides of the impeller portion 2 is smoothly guided to the blades 22 by the connecting portion 21*a*. In the preferred embodiment of the present invention shown in FIG. 10, most of the outer side surface 3216 of the yoke 321*a* is exposed, and the blower efficiency of the fan may be improved.

While embodiments of the present invention have been described in the foregoing, the present invention is not limited to the preferred embodiments detailed above, and various modifications are possible.

For example, in the viewpoint of preventing relative movement between the impeller portion 2 and the yoke 321, the fan 1 according to the first preferred embodiment of the present invention may include concave portions engaging with the convex portions 214 of the connecting portion 21, instead of the through holes 3217 on the upper surface of the flange portion 3215. Alternatively, concave portions may be formed on the flange portion 3215 by notching the outer circumference thereof, and the concave portions may be engaged with convex portions which are formed on the connecting portion 21. Alternatively, relative movement between the impeller portion 2 and the yoke 321 in the circumferential direction may be prevented by engaging the side affixing portion 213 of the connecting portion 21 and concave portions arranged on the outer circumferential surface of the flange portion 3215. Alternatively, as shown in FIG. 5, in the fan 1, a convex portion 214 may be formed on the flange portion 3215, and a hole 3217 into which the convex portion 214 is inserted (or a concave portion which engages with the convex portion) may be formed on the connecting portion 21.

Similarly, in the fan according to the second preferred embodiment of the present invention, the convex portions (the notched portions) instead of the holes 3217*a* may be formed on the outer side surface 3216 of the yoke 321*a*. Alternatively, the holes (or the concave portions) may be formed on the affixing portion 213*c* of the connecting portion 21*a*, and the convex portions which are inserted into the holes may be formed on the outer side surface 3216 of the yoke 321*a*.

Figure 11:
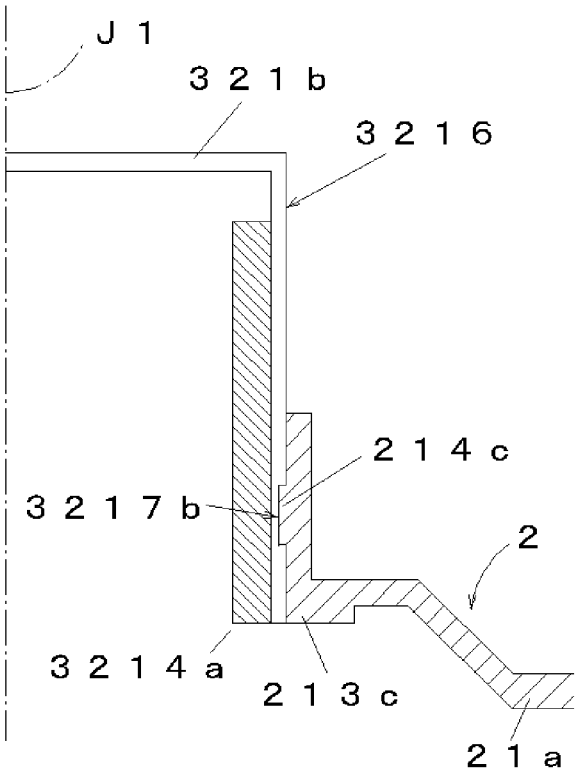
FIG. 11 is a cross sectional view illustrating a fan according to a third preferred embodiment of the present invention.

Next, a fan according to a third preferred embodiment of the present invention will be described. FIG. 11 is a cross sectional view illustrating a yoke 321*b* and the impeller portion 2 of a fan according to the third preferred embodiment of the present invention. Similar to the fan according to the second preferred embodiment of the present invention illustrated FIG. 9, the fan according to the third preferred embodiment of the present invention does not include a flange portion arranged around the opening 3214*a* of the yoke 321*b*.

As illustrated in FIG. 11, in the third preferred embodiment, a connecting portion 21*a* of the impeller portion 2 is fixed to a lower portion of the outer side surface 3216 of the yoke 321*b* (i.e., an opening-3214*a* side) by insert molding. An affixing portion 213*c* of the connecting portion 21*a* which abuts against the yoke 321*b* on the inner side of the connecting portion 21*a* covers a portion of the outer side surface 3216 of the yoke 321*b*. Other portion of the outer side surface 3216 is not covered with the impeller portion 2. Therefore, as described in the first preferred embodiment, the impeller portion 2 is solidly fixed to the yoke 321*b* while improving the blower efficiency of the fan.

Figure 12:
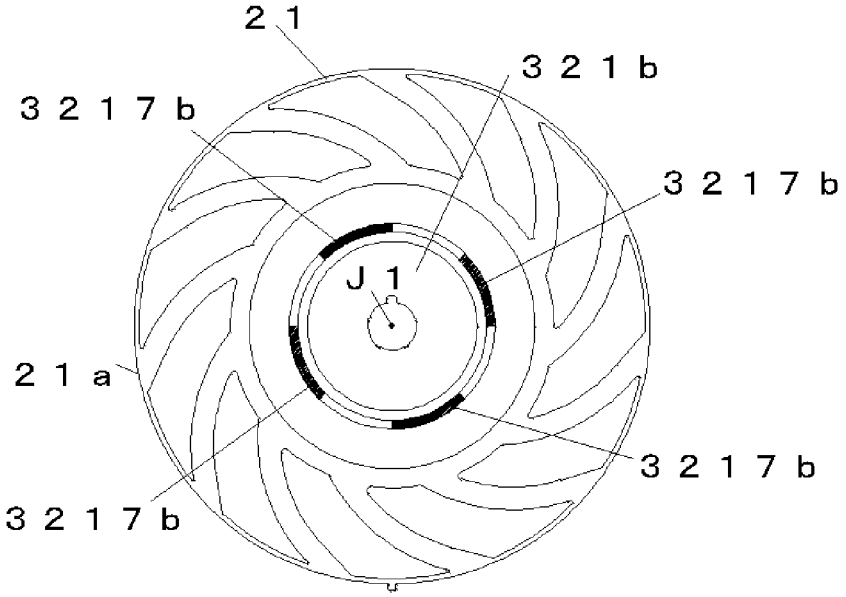
FIG. 12 is a bottom plane view illustrating the yoke and the connecting portion.

FIG. 12 is a bottom plan view illustrating the connecting portion 21 attached to the yoke 321*b*. As illustrated in FIG. 12, four grooves 3217*b* extending along the circumferential direction are arranged in the outer side surface 3216 of the yoke 321*b* in a manner symmetrical with respect to the center axis J1. Alternatively, the four grooves 3217*b* may be arranged in a substantially equally spaced manner in the circumferential direction (e.g., the four grooves 3217*b* may be arranged in equiangularly spaced manner about the center axis J1).

In the present preferred embodiment of the present invention, a metal plate is pressed and formed into the cylindrical shape of yoke 321*b*. In the process of pressing the metal plate into the cylindrical shape, the groove 3217*b* is concurrently formed by pressing or the like process. Alternatively, the groove 3217*b* may be formed after the metal plate is formed into the cylindrical shape of the yoke 321*b* by pressing, cutting and the like.

Four convex portions 214*c* to be inserted into the four grooves 3217*b* are formed on the affixing portion 213*c* of the connecting portion 21*a* by insert molding. By the configuration, as described in the first and second preferred embodiments of the present invention, it is possible to prevent the relative movement into the circumferential direction and/or the axial direction between the impeller portion 2 and the yoke 321*b* when the impeller portion 2 rotates. Additionally, since the four grooves 3217*b* extending along the circumferential direction are arranged in the manner symmetrical with respect to the center axis J1, the weight balance of the yoke 321*b* may be preferably maintained when the impeller portion 2 rotates.

In the present preferred embodiment of the present invention illustrated in FIG. 12, four grooves 3217*b* are arranged in the outer circumferential surface 3216 of the yoke 321*b*, but the number of grooves may be variously modified. The positions and/or the shapes of the grooves may be variously modified such that the balance of the yoke 321*b* is preferably maintained. Additionally, a portion or all of the grooves 3217*b* may be arranged in a manner overlapping to each other along the axial direction.

Figure 13:
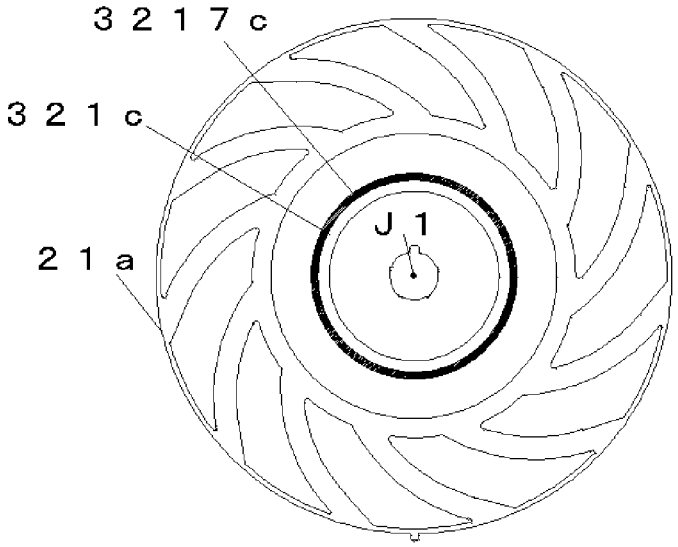
FIG. 13 is a bottom plane view illustrating another example of the connecting portion and the yoke.

The circular groove 3217*c* may be formed in the outer side surface 3216 of the yoke 321*c*. FIG. 13 is a bottom plan view illustrating the connecting portion 21*a* attached to the yoke 321*c*.

As illustrated in FIG. 13, the circular groove 3217*c* extending substantially entire circumference of the yoke 321*c* is formed in the outer side surface 3216 of the yoke 321*c*. In pressing the yoke 321*c*, the groove 3217*c* can be concurrently formed by pressing. Alternatively, the groove 3217*c* can be formed by pressing, cutting and the like after the yoke 321*b* is formed.

A convex portion to be inserted into the circular groove 3217*c* is formed on the affixing portion 213*c* of the connecting portion 21*a* by insert molding. By the configuration, as described in the first and second preferred embodiments of the present invention, it is possible to prevent the relative movement into the circumferential direction and/or the axial direction between the impeller portion 2 and the yoke 321*c* when the impeller portion 2 rotates. In the insert molding, the resin used for forming the convex portion can flow into the groove 3217*c* smoothly due to the round shape of the groove 3217*c*. Additionally, due to the round shape of the groove 3217*c*, the balance of the yoke 321*c* may be preferably maintained. Furthermore, the circular groove 3217*c* is more easily formed comparing with the groove(s) having other shapes, facilitating the manufacture of the yoke 321*c*. Additionally, a plurality of the circular grooves 3217 *c* axially separated from each other may be formed in the outer side surface 3216 of the yoke 321*c*.

Figure 14:
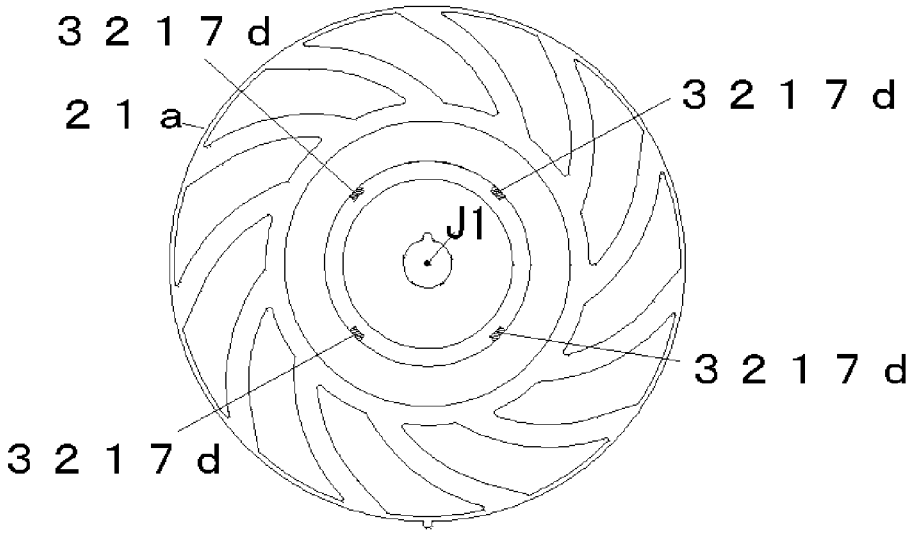
FIG. 14 is a bottom plan view illustrating another example of the connecting portion and the yoke
Figure 15:
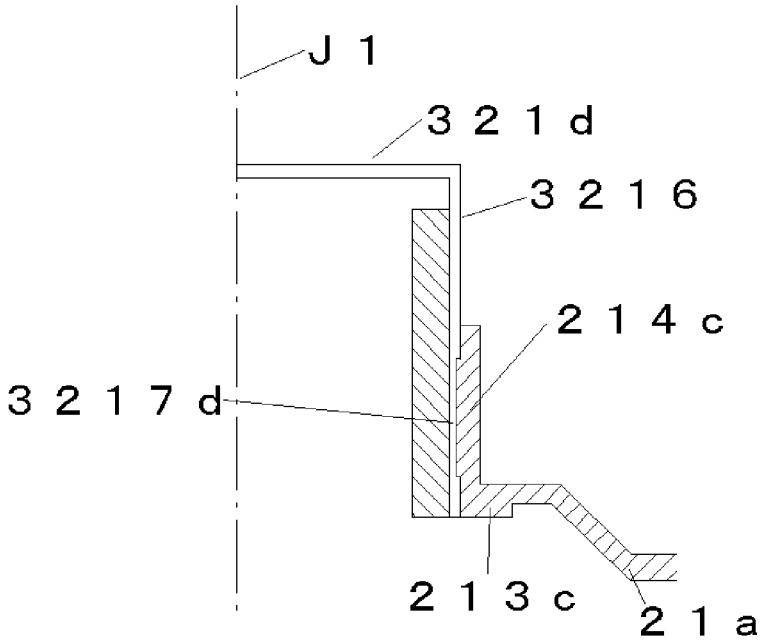
FIG. 15 is a cross sectional view illustrating the yoke and the impeller.

A groove extending along the axial direction may be formed in the outer side surface of the yoke. FIG. 14 is a bottom plan view illustrating the connecting portion 21*a* attached to the yoke 321*d*. FIG. 15 is a cross sectional view illustrating the yoke 321*d* and the impeller portion 2*a*.

As illustrated in FIGS. 14 and 15, the four grooves 3217*d* extending along the axial direction arranged in a manner symmetrical with respect to the center axis J1. Alternatively, the four grooves 3217*d* may be arranged in a substantially equally spaced manner in the circumferential direction (e.g., the four grooves 3217*d* are arranged in equiangularly spaced manner about the center axis J1).

The groove 3217*d* may be concurrently formed by pressing when the metal plate is pressed into the cylindrical shape of the yoke 321*c*. Alternatively, the groove 3217*d* may be formed by pressing, cutting and the like after the metal plate is formed into the cylindrical shape of the yoke 321*d*. Four convex portions 214*c* to be inserted into the four grooves 3217*d* are formed on the affixing portion 213*c* of the connecting portion 21*a* by insert molding. By the configuration, as described in the first and second preferred embodiments of the present invention, it is possible to prevent the relative movement into the circumferential direction and/or the axial direction between the impeller portion 2 and the yoke 321*d* when the impeller portion 2 rotates. Additionally, since the four grooves 3217*d* extending along the circumferential direction are arranged in a manner symmetrical with respect to the center axis J1, the balance of the yoke 321*d* may be preferably maintained when the impeller portion 2 rotates.

In the present preferred embodiment of the present invention illustrated in FIG. 14, four grooves 3217*d* are arranged in the outer circumferential surface 3216 of the yoke 321*d*. It should be noted, however, the number of the grooves 3217*d* provided to the yoke 321*d* is not limited to four, which may be variously modified. Also, the grooves 3217*d* are not necessarily arranged in the manner symmetrical with respect to the center axis J1. The positions and/or the shapes of the grooves may be variously modified such that the balance of the yoke 321*d* is preferably maintained. Additionally, a plurality of the grooves 3217*d* are formed to be overlapped along the axial direction.

Figure 16:
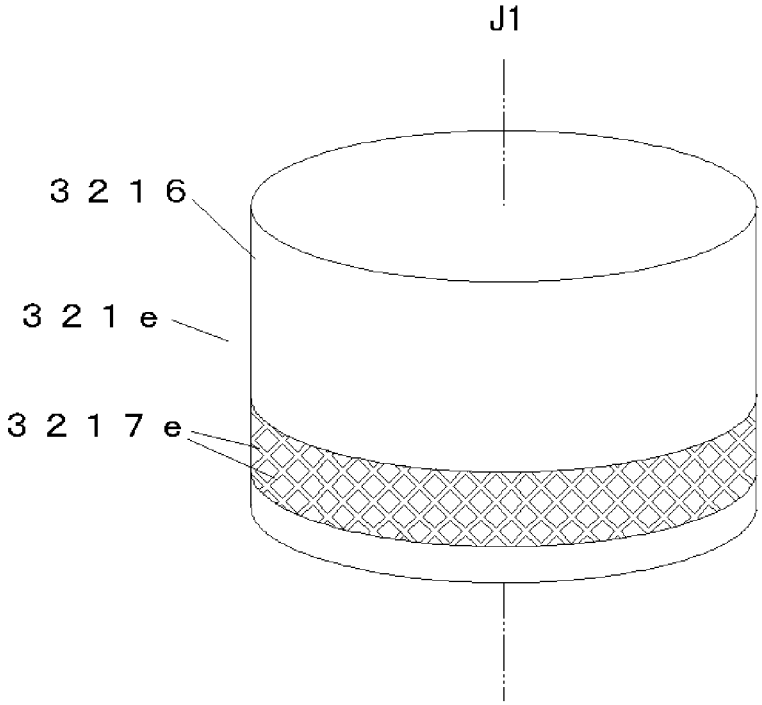
FIG. 16 is a perspective view illustrating another example of the yoke.

A groove formed on the portion of the outer side surface of the yoke may be inclined to the center axis J1. FIG. 16 is a perspective view illustrating the yoke 321*e* without the impeller portion 2. As illustrated in the FIG. 16, the grooves 3217*e* inclined to the center axis J1 may be formed in a lower portion of the outer peripheral surface 3216. The grooves 3217*e* may be formed by pressing or cutting. Alternatively, the grooves 3217*e*, as well as the groove 3217*b*, 3217*c*, and 3217*d*, may be formed by knurling.

A plurality of convex portions to be inserted into the grooves 3217*e* are formed on the affixing portion 213*c* of the connecting portion 21*a* by insert molding. By the configuration, as described in the first and second preferred embodiments of the present invention, it is possible to prevent the relative movement in the circumferential direction and the axial direction between the impeller portion 2 and the yoke 321*e* when the impeller portion 2 rotates. In the insert molding, since the grooves are formed along the entire circumference of the yoke 321*e*, the resin flowing into the grooves are circumferentially equally distributed along entire circumference of the yoke 321*e*, allowing to maintain the preferable weight balance of the yoke 321*e*.

The grooves are not necessarily arranged along the entire circumference of the yoke 321*e*. The grooves may be formed in portions of the outer side surface 3216, arranged in a symmetrical manner with respect to the center axis J1. Alternatively, the portions in which the grooves are formed may be arranged in a substantially equally spaced manner in the circumferential direction (e.g., the four grooves 3217*e* may be arranged in equiangularly spaced manner about the center axis J1). By the configuration, the weight balance of the rotor yoke 321*e* may be preferably maintained. Also, all grooves 3217*e* formed on the yoke 321*e* may be inclined to not only same direction but also the different direction each other. In additionally, the grooves 3217*e* to be inclined to the center axis J1 may not cross each other. Furthermore, the number of the groove 3217*e* is not limited.

Additionally, the size of the above-mentioned grooves 3217*b*, 3217*c*, 3217*d*, and 3217*e* may be microscopic.

Figure 17:
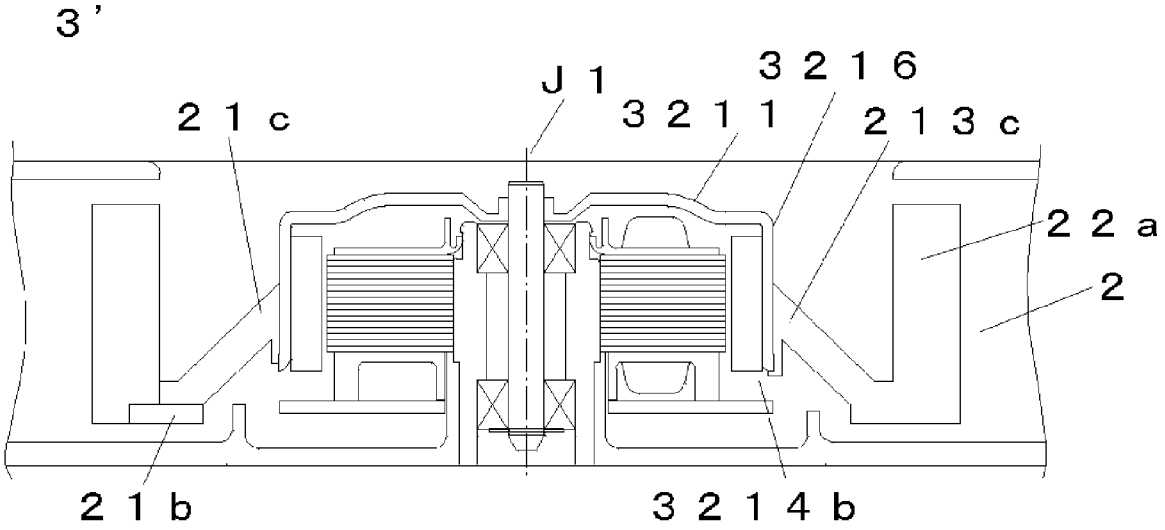
FIG. 17 is a cross sectional view illustrating a fan according to a fourth preferred embodiment of the present invention.

Next, with reference to FIGS. 17 to 19, a fan according to a fourth preferred embodiment of the present invention will be described. FIG. 17 is a cross sectional view illustrating the fan according to the fourth preferred embodiment of the present invention. Similar to the fan according to second and third preferred embodiments of the present invention, the fan according to the fourth preferred embodiment of the present invention does not include the flange portion arranged around the opening 3214*b* of the yoke 321*f*. The structures of the stator portion and the rotor portion are similar to those illustrated in FIG. 1.

Figure 18:
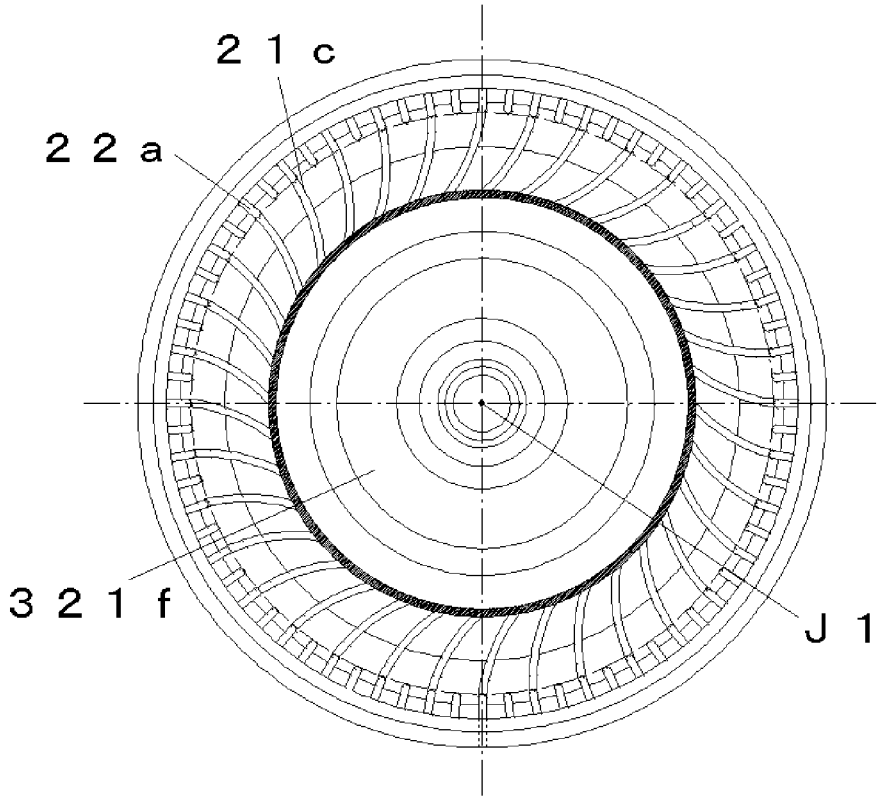
FIG. 18 is a plan view illustrating the yoke and the connecting portion.
Figure 19:
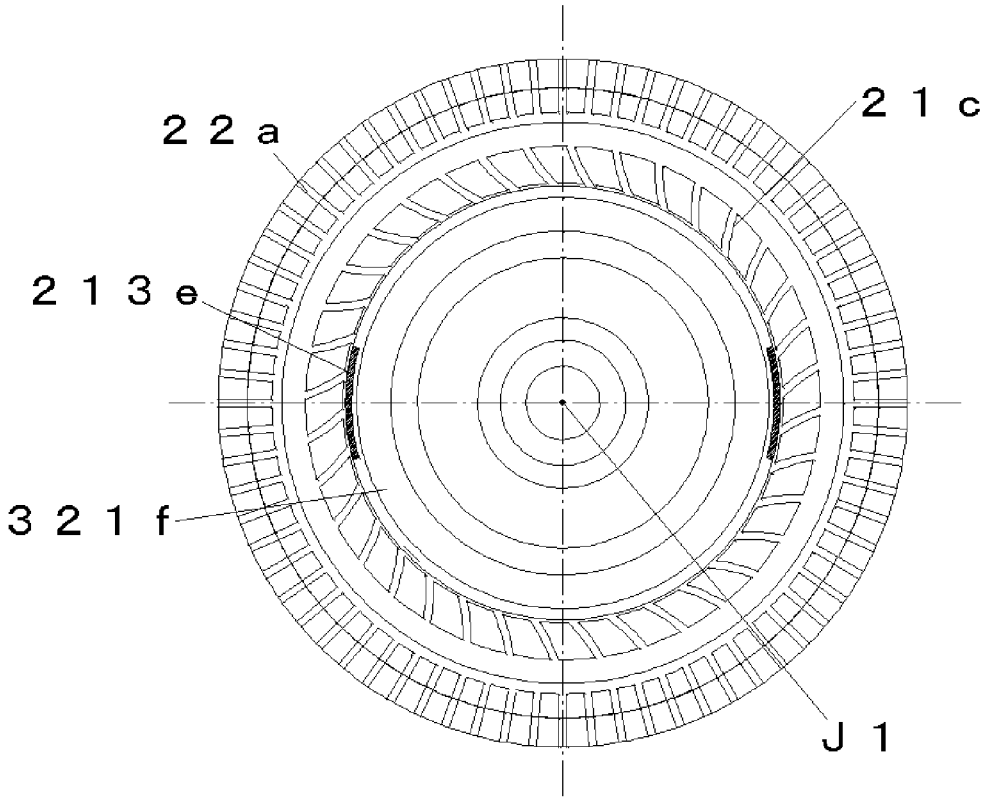
FIG. 19 is a bottom plane view illustrating the yoke and the connecting portion.

As illustrated in FIGS. 17 to 19, in the fourth preferred embodiment, a connecting portion 21*b* includes a substantially annular discoid portion. A plurality of blades 22*a* are arranged on the surface of the discoid portion of the connecting portion 21*b* in a substantially circumferentially equally spaced manner. Further more, the connecting portion 21*b* includes a plurality of ribs 21*c*, radially outside thereof integrally connected with the discoid portion and at least one of the plurality of blades 21*a*, and a radially inside thereof connected with the affixing portion 213*c* abutted against the yoke 321*f*. In the present preferred embodiment of the present invention, space opening to axially upper and lower sides of the impeller is defined between the yoke 321*f* and the discoid portion of the connecting portion 21*b*. By the configuration, the fan 3' may intake air from axially upper and lower sides thereof, increasing the air flow rate. Instead of the ribs 21*c*, a plurality of stator blades may be provided to increase the static pressure of the air taken inside of the fan 3'. Furthermore, by providing the space opened to axially upper and lower sides of the impeller, the mass of the impeller portion 2 is reduced, which reduces the electric current necessary to rotate the rotor portion as well.

The affixing portion 213*c* of the impeller portion 2 is fixed to an axially lower portion of the outer side surface 3216 (i.e., portion near from the opening 3214*b*) of the yoke 321*f* by insert molding. The affixing portion 213*c* includes a cylindrical section 213*d* and an axial affixing section 213*e*. The cylindrical section 213*d* radially covers a portion of the outer side surface 3216 of the yoke 321*f*, and the axial affixing section 213*e* (which may be referred to as a cover portion) axially covers an edge portion 3218 of the yoke 321*f* (i.e., an opening-3214*b*-side end of the yoke 321*f*). Other portion of the outer side surface 3216 is not covered with the cylindrical section 213*d* (i.e., the impeller portion 2). Therefore, likewise the other preferred embodiments of the present invention, the blower efficiency of the fan is improved while the impeller portion 2 is solidly fixed to the yoke 321*f*, preventing that the impeller portion 2 moves in the axial direction relative to the yoke 321*f* when the rotor portion rotates.

Figure 20:
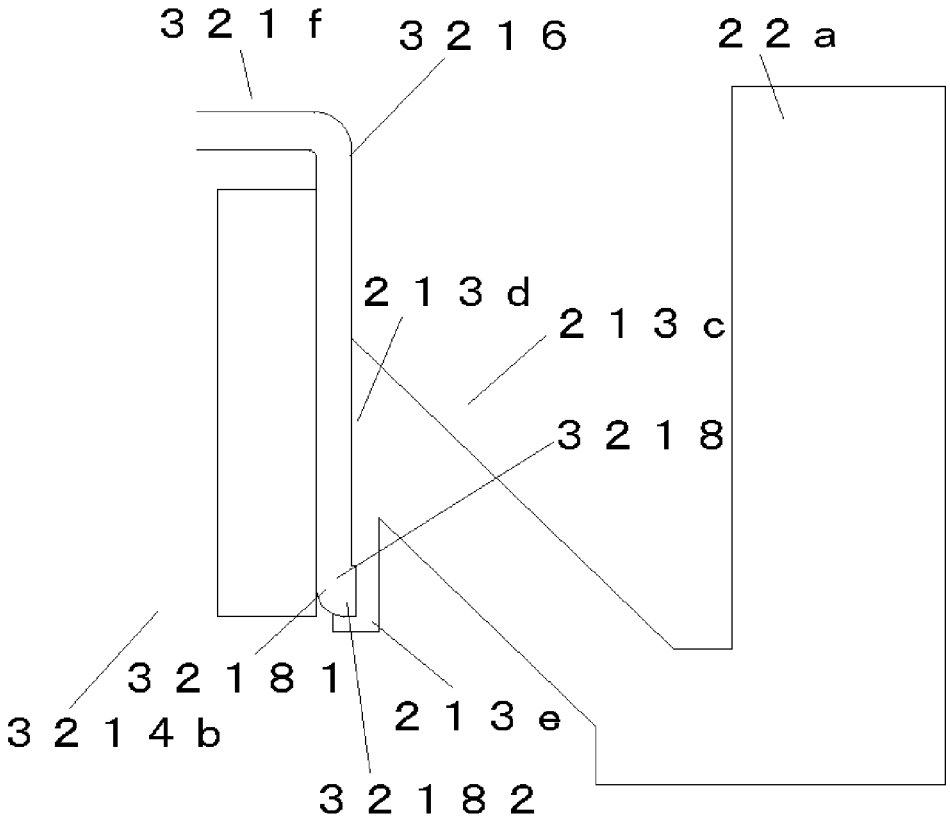
FIG. 20 is a cross sectional view illustrating the yoke in a magnified manner.

FIG. 20 is a cross sectional view illustrating the affixing portion 213*c* attached to the yoke 321*f* in a magnified manner. As illustrated in FIG. 20, the edge portion 3218 of the yoke 321*f* has an inner edge 32181 and an outer edge 32182. In the present preferred embodiment of the present invention, at least a part of the inner edge 32181 is chamfered. With the chamfered edge portion, it is easy to insert the field magnet 322 into the yoke 321*g*. The outer edge 32182 has a surface which is substantially perpendicular to the center axis J1. The axial affixing section 213*e* may be formed so as to cover only the perpendicular surface of the outer edge 32182.

The axial thickness of the axial affixing section 213*e* is preferably within the range of about 0.5 mm to about 1.0 mm. The coefficient of thermal expansion of the yoke 321*f* made of metal is higher than that of the axial affixing section 231*e* made of resin. When the heat is applied to the yoke 321*f* and the affixing portion 213*c* from the external or internal heat source (e.g., the stator portion), the affixing portion 213*c* may crack around the border. Also, at the border between the cylindrical portion 213*d* and the axial affixing section 213*e*, the other stress applied to the impeller portion 2 is often concentrated. The stress is generally in proportion to the axial thickness of the axial affixing section 213*e*. Therefore, the axial thickness of the axial affixing portion 213*e* is preferably within the range of about 0.5 mm to about 1.0 mm.

As illustrated in FIG. 19, two axial affixing sections 213*e* are arranged in the edge portion 3218 of the yoke 321*f* in a manner symmetrical with respect to the center axis J1. Alternatively, the axial affixing section 213*e* may be arranged in a substantially equally spaced manner in the circumferential direction. By the configuration, the weight balance of the yoke 321*f* may be preferably maintained when the impeller portion 2 rotates. It should be noted that the number of the axial affixing portion 231*e* may be variously modified. For example, the axial affixing section 231*e* may cover the entire circumference of the edge portion 3218 of the yoke 321*f*. Additionally, the axial affixing section 231*e* may cover the chamfered portion of the inner edge 32181 along the circumferential direction.

Through the configuration described above, it is possible to prevent the relative movement in the circumferential direction and/or the axial direction between the impeller portion 2 and the yoke 321*f* when the impeller portion 2 rotates. Furthermore, the amount of the resin to be used for molding injection may be reduced.

The features of the present preferred embodiment may be combined with second or third embodiment. For example, the grooves could be formed on the outer side surface 3216 of the yoke 321*b*.

While preferred embodiments of the present invention have been described above, it is to be understood that variations and modifications will be apparent to those skilled in the art without departing the scope and spirit of the present invention. The scope of the present invention, therefore, is to be determined solely by the following claims.

What is claimed is:

1. A fan comprising:

a stator unit; and a rotor unit rotatable about a center axis, the rotor unit including:

a yoke made of metal and having a substantially hollow cylindrical shape centering on the center axis; and an impeller portion made of resin and including a connecting portion and a plurality of blades arranged around the center axis on the connecting portion, the connecting portion being fixed to the yoke by being fastened to a flange portion of the yoke which extends in a radially outward direction from the center axis; wherein the connecting portion of the impeller portion is arranged to cover both of axial surfaces of the flange portion of the yoke and at least one radial surface of the flange portion of the yoke, the connecting portion including both an upper fixing portion arranged at a position axially above the flange portion of the yoke to cover an axially upper portion of the flange portion of the yoke and a lower fixing portion arranged at a position axially below the flange portion of the yoke to cover an axially lower portion of the flange portion of the yoke such that the flange portion of the yoke is sandwiched between the upper fixing portion and the lower fixing portion, the axially lower portion including a portion of an axially lowermost surface of the yoke;

the yoke includes an innate surface which is a portion of an outer side surface of the yoke not covered by the connecting portion;

the impeller portion intakes air from a direction along the center axis, and exhausts air into a direction away from the center axis;

a magnet is fixed to a surface of the yoke such that the magnet is in direct surface-to-surface contact with an inner surface of the yoke; and the connecting portion includes a plurality of bottom affixing portions arranged to be spaced apart in a circumferential direction of the rotor unit.

2. A fan as set forth in claim 1, wherein the connecting portion of the impeller portion has a discoid circular shape extending radially outwardly from the yoke.

3. A fan as set forth in claim 1, wherein the connecting portion includes a plurality of ribs extending radially between the yoke and the plurality of blades.

4. The fan as set forth in claim 1, wherein the innate surface of the yoke faces inner edges of the plurality of blades in the radial direction.

5. The fan as set forth in claim 2, wherein the connecting portion of the impeller portion includes:

a radial affixing portion arranged around the center axis, and including a surface or an edge which constrains the radial position of the discoid circular portion against the yoke; and an axial affixing portion including a surface or an edge which extends in the radial direction and constrains the axial position of the connecting portion against the yoke.

6. The fan as set forth in claim 5, wherein the discoid circular portion is formed by insert molding, a plurality of weld lines extends radially on the discoid circular portion with the center axis as the center, and each of the weld lines passes between two adjacent radial affixing portions.

7. The fan as set forth in claim 5, wherein the connecting portion includes a gate mark at a position radially outward from those of the radial affixing portion substantially on an extension of a line connecting both of the radial affixing portion and the center axis in a plan view.

8. The fan as set forth in claim 7, wherein the gate mark is arranged on a portion of the connecting portion which axially overlaps with the flange portion.

9. The fan as set forth in claim 1, wherein the yoke includes a convex portion, and the impeller portion includes a hole portion or a concave portion; and the convex portion is inserted into the hole portion or the concave portion to prevent relative movement between the yoke and the impeller portion.

10. The fan as set forth in claim 1, wherein the outer side surface of the yoke includes a hole portion, a concave portion, or a groove portion, and the impeller portion includes a convex portion; and the convex portion is inserted into the hole portion, the concave portion, or the groove portion to prevent relative movement between the yoke and the impeller portion.

11. The fan as set forth in claim 10, wherein the yoke includes the groove portion and the groove portion extends along a circumferential direction in the outer side surface of the yoke.

12. The fan as set forth in claim 10, wherein the yoke includes the groove portion and the groove portion extends along an axial direction.

13. The fan as set forth in claim 10, wherein a plurality of the hole portion, the concave portion, or the groove portion are arranged symmetrical with respect to the center axis.

14. The fan as set forth in claim 10, wherein the outer side surface of the yoke includes at least one groove portion which is inclined relative to the center axis.

15. The fan as set forth in claim 10, wherein a plurality of the hole portion, the concave portion, or the groove portion are arranged in a substantially circumferentially equally spaced manner.

16. The fan as set forth in claim 1, wherein the yoke includes a closed top and an open bottom in the axial direction, and the connecting portion includes a cover portion covering a bottom end of the yoke defining the open bottom in the axial direction.

17. The fan as set forth in claim 16, wherein the connecting portion includes a plurality of the cover portion arranged in a substantially equally spaced manner in a circumferential direction.

18. The fan as set forth in claim 16, wherein an axial thickness of the cover portion is from about 0.5 mm to about 1.0 mm.

19. The fan as set forth in claim 16, wherein:

the bottom end includes an inner side edge and an outer side edge in the radial direction;

at least a portion of the inner side edge is chamfered and is covered by the cover portion; and the outer side edge includes a surface perpendicular to the center axis and at least a portion thereof is covered by the cover portion.

20. The fan as set forth in claim 1, wherein the axially lower portion of the yoke is arranged directly adjacent to a radially outer edge of the flange portion of the yoke and is arranged such that portions of the axially lower portion of the yoke are exposed to face a base portion of the stator unit without being axially covered by the plurality of bottom affixing portions.

21. The fan as set forth in claim 20, wherein the connecting portion includes a plurality of side affixing portions arranged to be spaced apart in the circumferential direction of the rotor unit.

22. The fan as set forth in claim 21, wherein the radially outer edge of the flange portion of the yoke is arranged such that portions thereof are exposed without being radially covered by the plurality of side affixing portions.

23. A fan comprising:

a stator unit; and a rotor unit rotatable about a center axis, the rotor unit including:

a yoke made of metal and having a substantially hollow cylindrical shape centering on the center axis with a flat radially extending disk-shaped portion provided on an upper end thereof; and an impeller portion made of resin and having a connecting portion and a plurality of blades arranged around the center axis on the connecting portion, the connecting portion being fixed to the yoke; wherein the connecting portion of the impeller portion is attached to the yoke;

the yoke includes an innate surface which is a portion of a radially outer side surface of the yoke which extends from the flat radially extending disk-shaped portion and which is not overlapped in a radial direction by the connecting portion;

the impeller portion intakes air from a direction along the center axis, and exhausts air into a direction away from the center axis;

the radially outer side surface of the yoke includes a hole portion, a concave portion, or a groove portion, and the impeller portion includes a convex portion; and the convex portion is inserted into the hole portion, the concave portion, or the groove portion to prevent relative movement between the yoke and the impeller portion; and a magnet is fixed to a surface of the yoke such that the magnet is in direct surface-to-surface contact with an inner surface of the yoke.

24. The fan as set forth in claim 23, wherein a plurality of the hole portion, the concave portion, or the groove portion are arranged in a substantially circumferentially equally spaced manner.

25. A fan comprising:

a stator unit; and a rotor unit rotatable about a center axis, the rotor unit including:

a yoke made of metal and having a substantially hollow cylindrical shape centering on the center axis; and an impeller portion made of resin and including a connecting portion and a plurality of blades arranged around the center axis on the connecting portion, the connecting portion being fixed to the yoke by being fastened to a flange portion of the yoke which extends in a radially outward direction from the center axis; wherein the connecting portion of the impeller portion is arranged to cover both of axial surfaces of the flange portion of the yoke and at least one radial surface of the flange portion of the yoke, the connecting portion including both an upper fixing portion arranged at a position axially above the flange portion of the yoke to cover an axially upper portion of the flange portion of the yoke and a lower fixing portion arranged at a position axially below the flange portion of the yoke to cover an axially lower portion of the flange portion of the yoke such that the flange portion of the yoke is sandwiched between the upper fixing portion and the lower fixing portion, the axially lower portion including a portion of an axially lowermost surface of the yoke;

the yoke includes an innate surface which is a portion of an outer side surface of the yoke not covered by the connecting portion;

the impeller portion intakes air from a direction along the center axis, and exhausts air into a direction away from the center axis;

a magnet is fixed to a surface of the yoke such that the magnet is in direct surface-to-surface contact with an inner surface of the yoke; and the connecting portion includes a plurality of side affixing portions arranged to be spaced apart in a circumferential direction of the rotor unit.

26. The fan as set forth in claim 25, wherein the axially lower portion of the yoke is arranged directly adjacent to a radially outer edge of the flange portion of the yoke and the radially outer edge of the flange portion of the yoke is arranged such that portions thereof are exposed without being radially covered by the plurality of side affixing portions.

* * * * *